US010975595B2

(12) United States Patent
Hickman et al.

(10) Patent No.: US 10,975,595 B2
(45) Date of Patent: Apr. 13, 2021

(54) AUTOMATIC CONNECTING SYSTEM WITH HEAT-ACTIVATED RELEASE

(71) Applicant: BEST ACCESS SOLUTIONS, INC., Indianapolis, IN (US)

(72) Inventors: Chad Hickman, Rensselaer, IN (US); Brendon Allen, Indianapolis, IN (US)

(73) Assignee: dormakaba USA Inc., Indianapolis, IN (US)

( * ) Notice: Subject to any disclaimer, the term of this patent is extended or adjusted under 35 U.S.C. 154(b) by 420 days.

(21) Appl. No.: 15/772,238

(22) PCT Filed: Oct. 28, 2016

(86) PCT No.: PCT/US2016/059459
§ 371 (c)(1),
(2) Date: Apr. 30, 2018

(87) PCT Pub. No.: WO2017/075447
PCT Pub. Date: May 4, 2017

(65) Prior Publication Data

US 2018/0313113 A1 Nov. 1, 2018

Related U.S. Application Data

(60) Provisional application No. 62/248,697, filed on Oct. 30, 2015.

(51) Int. Cl.
*E05B 17/00* (2006.01)
*E05B 47/00* (2006.01)
(Continued)

(52) U.S. Cl.
CPC ..... *E05B 17/0075* (2013.01); *E05B 9/02* (2013.01); *E05B 47/00* (2013.01); *E05B 15/06* (2013.01);
(Continued)

(58) Field of Classification Search
CPC ... E05B 9/00; E05B 9/002; E05B 9/08; E05B 17/0075; E05B 47/00; E05B 47/0012;
(Continued)

(56) References Cited

U.S. PATENT DOCUMENTS 5,783,995 A * 7/1998 Jackson ..... E05B 45/06 200/61.67
6,016,677 A 1/2000 Clark
(Continued)

FOREIGN PATENT DOCUMENTS

CN 104379858 A 2/2015

OTHER PUBLICATIONS

International Preliminary Report on Patentability for PCT/US2016/059459, dated May 1, 2018, 7 pages.
(Continued)

*Primary Examiner* — Christopher J Boswell
(74) *Attorney, Agent, or Firm* — Faegre Drinker Biddle & Reath LLP

(57) ABSTRACT

A control module for a motorized door lock assembly includes a mounting bracket that is electrically connected to the door lock with wiping electrical terminals, and a housing with counterpart wiping electrical terminals that are electrically connected to a battery subassembly and an electric circuit. As a result, the battery subassembly and electric circuit can be quickly connected to the door lock merely by sliding the housing over the mounting bracket. Accordingly, the need for complicated and expensive connection systems is eliminated. Such an array of mutual wiping terminals also makes it possible to use the force of gravity to jettison the housing and its contents from the door lock in the event of a fire.

19 Claims, 18 Drawing Sheets

(51) Int. Cl.
*E05B 9/02* (2006.01)
*E05B 15/16* (2006.01)
*E05B 15/06* (2006.01)

(52) U.S. Cl.
CPC ..... *E05B 15/16* (2013.01); *E05B 47/0012* (2013.01); *E05B 2047/0058* (2013.01); *E05B 2047/0094* (2013.01)

(58) Field of Classification Search
CPC ..... E05B 2047/0057; E05B 2047/0058; E05B 2047/0071; E05B 2047/0094
See application file for complete search history.

(56) References Cited

U.S. PATENT DOCUMENTS 6,655,180 B2 * 12/2003 Gokcebay ..... G07C 9/00674 70/432
8,079,240 B2 * 12/2011 Brown ..... E05B 47/0676 70/277
8,272,241 B2 * 9/2012 Brown ..... E05B 47/0676 70/277
8,272,242 B1 9/2012 Lee
9,129,457 B2 * 9/2015 Sumcad ..... E05B 47/0676
10,317,247 B1 * 6/2019 Wernlund ..... E06B 7/28
10,683,677 B1 * 6/2020 Funamura ..... E05B 45/00
2002/0125992 A1 * 9/2002 Harwood ..... E05B 63/0056 340/5.51
2009/0193059 A1 7/2009 Wall et al.
2009/0193859 A1 8/2009 Kwon et al.
2011/0285501 A1 * 11/2011 Chen ..... E05B 47/0012 340/5.7
2012/0079859 A1 4/2012 Lakamraju et al.
2014/0260929 A1 9/2014 Leites et al.
2018/0061163 A1 * 3/2018 Ku ..... G07C 9/00896
2020/0232255 A1 * 7/2020 Langenberg ..... E05B 55/005

OTHER PUBLICATIONS

International Search Report for PCT/US2016/059459, dated Mar. 3, 2017, 4 pages.
Office Action issued in Chinese Patent Application No. 201680071371.6, dated Mar. 13, 2020, 30 pages (English translation).

* cited by examiner

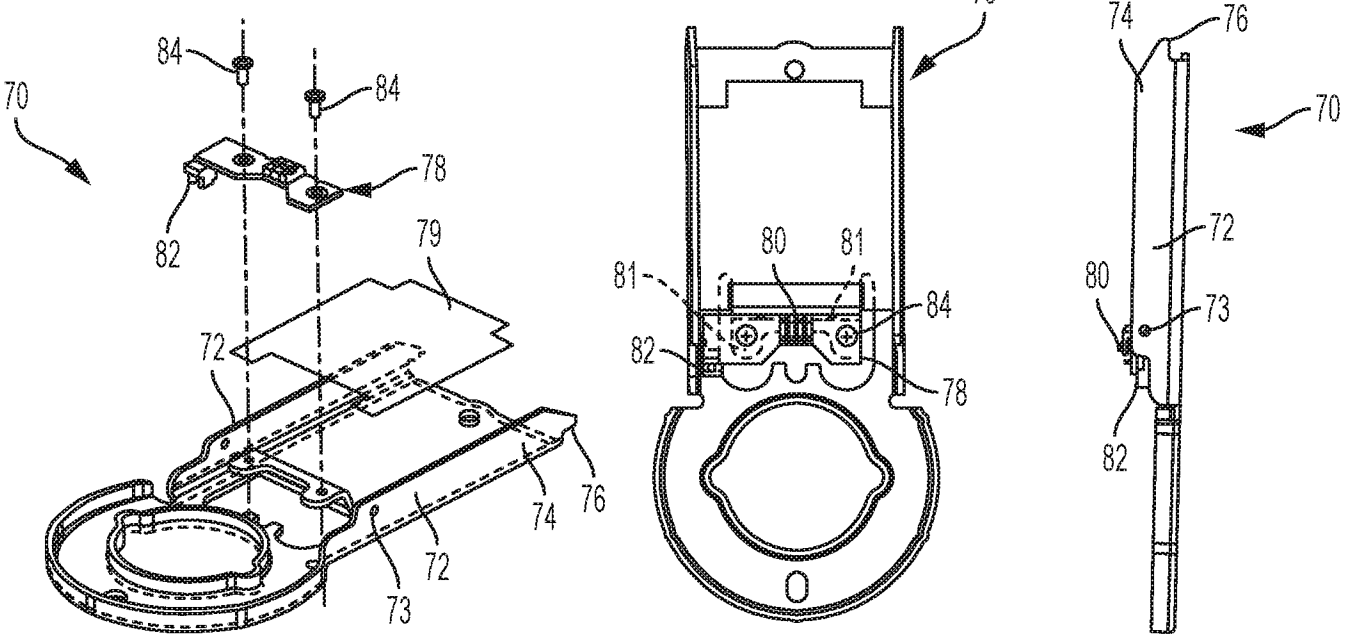
FIG. 9C
FIG. 9B
FIG. 9A
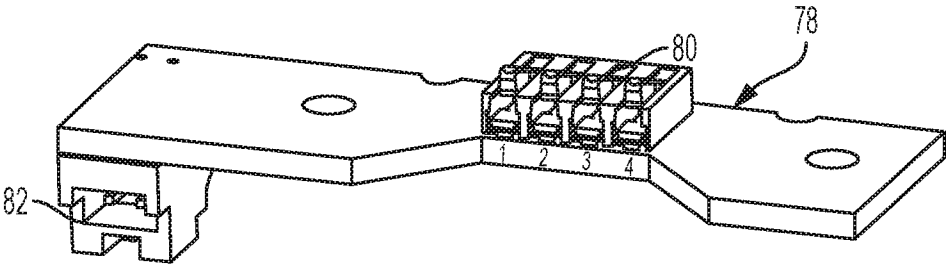
FIG. 9D

AUTOMATIC CONNECTING SYSTEM WITH HEAT-ACTIVATED RELEASE

CROSS-REFERENCE TO RELATED APPLICATIONS

This application claims the benefit of U.S. Provisional Application Ser. No. 62/248,697, filed Oct. 30, 2015, the entire disclosure of which is hereby incorporated herein by reference.

BACKGROUND OF THE INVENTION

1. Field of the Invention

The present invention relates to control modules, and particularly to control modules for mounting on motor-driven door locks.

2. Description of the Related Art

Motor-driven door locks, for example those intended for used in schools as part of a classroom lockdown system, frequently contain mechanisms that permit the locks to be both manually and remotely actuated. However, conventional control systems for motor-driven door locks typically require complex means for attaching their respective electronics packages to the door lock. For example, one such means requires that plug-and-socket connections be manually made between the electronics package of the controller, and the lock. Such a connection system inevitably adds costs and completion time to the installation of each lock, which costs are multiplied by the number of classrooms and other protected spaces in the school. Another connection system requires that a wiring harness be manually strung from the electronics package to respective portions of the door lock. Again, such a system adds cost and installation time to the total school protection project.

Furthermore, when installing conventional electronic packages to door locks, it is frequently necessary to drill additional holes in the door. Also it is typically necessary to use tools to both mechanically and electrically connect the electronics package to the door lock.

As can be seen, the common denominator among all such conventional connection systems is that they add cost and installation time to the overall project. Moreover, the respective structures of such conventional connection systems, by their very natures, add even more costs by requiring additional complicated mechanisms to comply with U.L. fire standards.

Motor-driven door locks, among other lock systems, must be designed to meet, for example, the burn test of U.L. Standard 10-C. In a nutshell, the flammable contents of their respective electronic packages, such as batteries and electric circuits, must be released or jettisoned from the door in the event of a fire before the ambient temperature reaches the respective ignition points of the batteries and electric circuits. So far, conventional attempts to solve this problem have been unsatisfactory. The difficulties that designers face in jettisoning batteries and electronics from motor-driven door locks are often linked to the means with which such elements are connected to the door locks in the first place.

For example, one connection system requires that the electronic package not only be electrically connected to the door lock by a plug-and-socket arrangement, but also that the electronics package actually be supported on the door lock by the same plug-and-socket arrangement. One proposed solution was to fill a portion of the space between the electronics package and its mounting bracket with a heat-expandable material, so that when a fire increased the ambient temperature above a certain level, the heat-expandable material would balloon and forcibly eject the electronics before the ambient temperature reached the ignition point.

Another approach was to load a compression spring between the mounting bracket and a heat-sensitive retainer attached to the outermost end of the spring and the mounting bracket. The electronics were disposed on the other side of the heat-sensitive retainer. As the ambient temperature rose, the heat-sensitive retainer would deteriorate and the compression spring would be released, thereby jettisoning the electronics from the door lock.

Thus the very structures of such conventional connection systems likely resulted in an unanticipated snowballing of costs for the entire lockdown project to meet fire standards.

What is needed, therefore, is a fast but effective connection system that automatically connects the batteries and electronics of a control module with a motor-driven door lock, without using expensive manually-installed plug-and-socket connections or wiring harnesses, and which does not require that additional holes be drilled in the doors, nor that tools be used to make the electrical connections. Ideally, such an improved connection system should also meet U.L. fire standards without requiring additional mechanisms to jettison the batteries and electronics from the door lock in the event of a fire.

SUMMARY OF THE INVENTION

It has been discovered that by designing a connection system with the jettisoning problem in mind, both the quick-connect and the jettison problems could be solved simultaneously. The quick-connect problem is solved by providing a control module with a mounting bracket that is electrically connected to the door lock with wiping electrical terminals, and by providing a housing having counterpart wiping electrical terminals that includes the batteries and electric circuit. As a result, the batteries and electric circuit can be quickly connected to the door lock merely by sliding the housing over the mounting bracket. Accordingly, the present invention eliminates the need for complicated and expensive connection systems, for drilling additional holes in the doors, and for requiring tools to electrically connect the batteries and electric circuit with the door lock.

By design, such an array of mutual wiping terminals of the present invention makes it possible to use solely the force of gravity, in concert with using heat from a fire to melt certain portions of the housing, to jettison the housing and its contents from the door lock, thereby eliminating the conventional need for additional mechanisms to meet U.L. fire standards.

Accordingly, in one embodiment of a control module embodying the automatic-connecting system of the present invention, a mounting bracket connected to the door lock assembly includes a first plurality of wiping electrical terminals, at least one terminal of which is electrically connected to the door lock assembly. A housing includes a battery subassembly and electric circuit, which are operatively associated with a second plurality of wiping electrical terminals disposed on the housing in a planar array. The first and second pluralities of wiping electrical terminals are configured for mutual electrical and mechanical wiping contact when the housing is moved parallel to the mounting bracket. No other electrical connections are required between the housing and the mounting bracket to electrically connect the batteries and the electrical circuit with the door lock assembly. The motor of the door lock assembly is electrically connected to the electric circuit when the housing is connected to the mounting bracket.

In another embodiment, an anti-tamper system is activated when the housing is connected to the mounting bracket, the anti-tamper system including a tamper-detecting circuit electrically connected between a terminal (or pair of terminals) in the second plurality of wiping electrical terminals and a microprocessor. The tamper-detecting circuit senses when such terminal is electrically disconnected from its electrical counterpart in the second plurality of wiping electrical terminals, and produces an output reflecting the existence of a tamper condition. In response to this output, the microprocessor generates an alert.

In still another embodiment, a plastic housing defines a detent which is engaged with a detent-engaging portion of the mounting bracket to releasably retain the housing subassembly on the mounting bracket. When the ambient temperature rises to a point at which the detent-engaging portion melts the detent, the housing is released from the mounting bracket, and solely the force of gravity causes the housing subassembly to fall away from the door lock assembly. Thus, in the heat-activated release system of the present invention, the housing subassembly is jettisoned before the ambient temperature reaches the respective ignition points of the batteries and electric circuit disposed in the housing.

Further embodiments include a method of automatically and releasably connecting the electric circuit with the motor of a lock assembly; and a method of using solely the force of gravity, in cooperation with melting at least a portion of the housing, to cause the housing to fall away from the mounting bracket.

In short, the structure of the automatic-connecting system of the present invention also yields a low-cost but elegant solution to meeting the UL fire standards.

The terminology used herein is for the purpose of describing particular embodiments only and is not intended to be limiting of the invention. As used herein, the singular forms, "a", "an" and "the" are intended to include the plural forms as well, unless the context clearly indicates otherwise. It will be further understood that the root terms "include" and/or "have", when used in this specification, specify the presence of stated features, steps, operations, elements, and/or components, but do not preclude the presence or addition of at least one other feature, step, operation, element, component, and/or groups thereof.

As used herein, the terms "comprises," "comprising," "includes," "including," "has," "having" or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus.

For definitional purposes and as used herein "connected" or "attached" includes physical or electrical, whether direct or indirect, affixed or adjustably mounted, as for example, the plurality of wiping terminals is operatively connected to the electric circuit. Thus, unless specified, "connected" or "attached" is intended to embrace any operationally functional connection.

As used herein "substantially," "generally," "slightly" and other words of degree are relative modifiers intended to indicate permissible variation from the characteristic so modified. It is not intended to be limited to the absolute value or characteristic which it modifies but rather possessing more of the physical or functional characteristic than its opposite, and approaching or approximating such a physical or functional characteristic.

In the following description, reference is made to accompanying drawings which are provided for illustration purposes as representative of specific exemplary embodiments in which the invention may be practiced. Given the following description of the specification and drawings, the apparatus and methods should become evident to a person of ordinary skill in the art. Further areas of applicability of the present teachings will become apparent from the description provided herein. It is to be understood that other embodiments can be utilized and that structural changes based on presently known structural and/or functional equivalents can be made without departing from the scope of the invention.

BRIEF DESCRIPTION OF THE DRAWINGS

The above-mentioned and other features and advantages of this invention, and the manner of attaining them, will become more apparent and the invention will be better understood by reference to the following descriptions of embodiments of the invention taken in conjunction with the accompanying drawings, wherein:

FIG. 9A is an exploded perspective detail view of the mounting bracket of FIG. 8.

FIG. 9B is a front elevational view of the mounting bracket of FIG. 9A.

FIG. 9C is a side elevational detail view of the mounting bracket of FIG. 9B.

FIG. 9D is an enlarged perspective detail view of the transfer board of FIG. 9A.

Corresponding reference characters indicate corresponding parts throughout the several views. The exemplifications set out herein illustrate embodiments of the present invention, and such exemplifications are not to be construed as limiting the scope of the present invention in any manner.

DETAILED DESCRIPTION OF THE INVENTION

Figure 1:
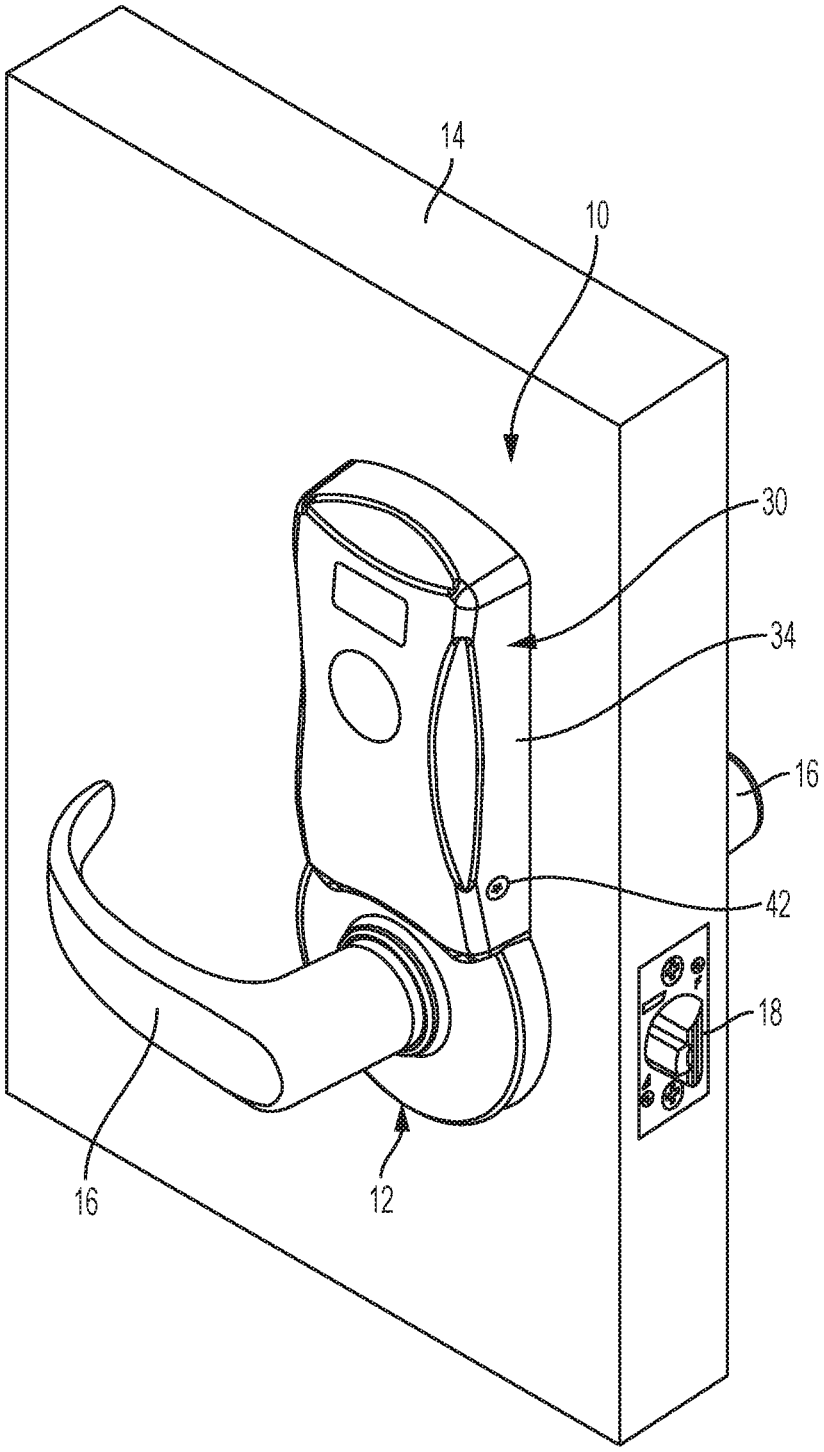
FIG. 1 is a perspective view of one embodiment of a control module embodying the automatic-connecting system of the present invention mounted on a door lock assembly.
Figure 2:
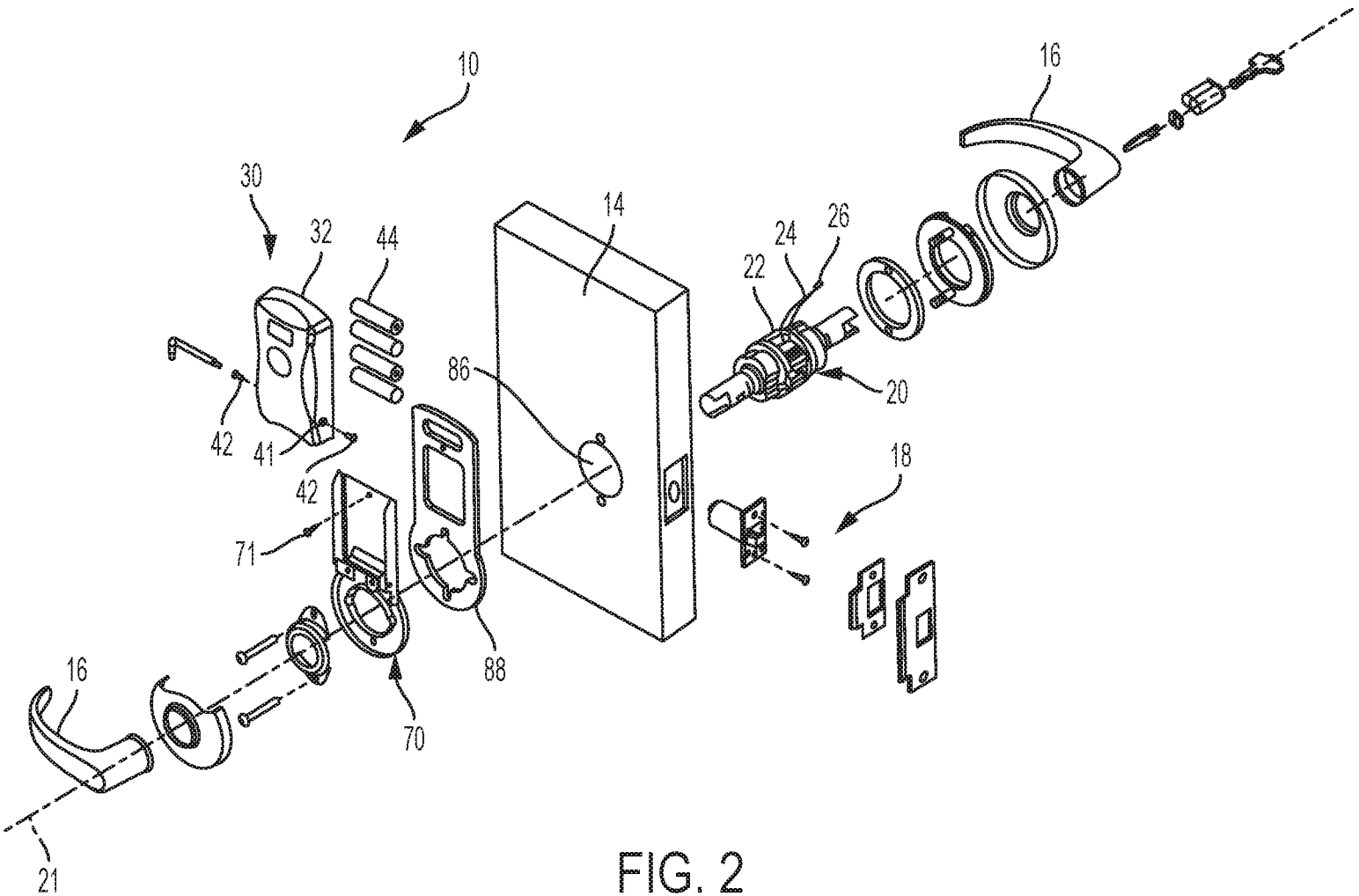
FIG. 2 is an exploded perspective view of the automatic-connecting system of FIG. 1.
Figure 3:
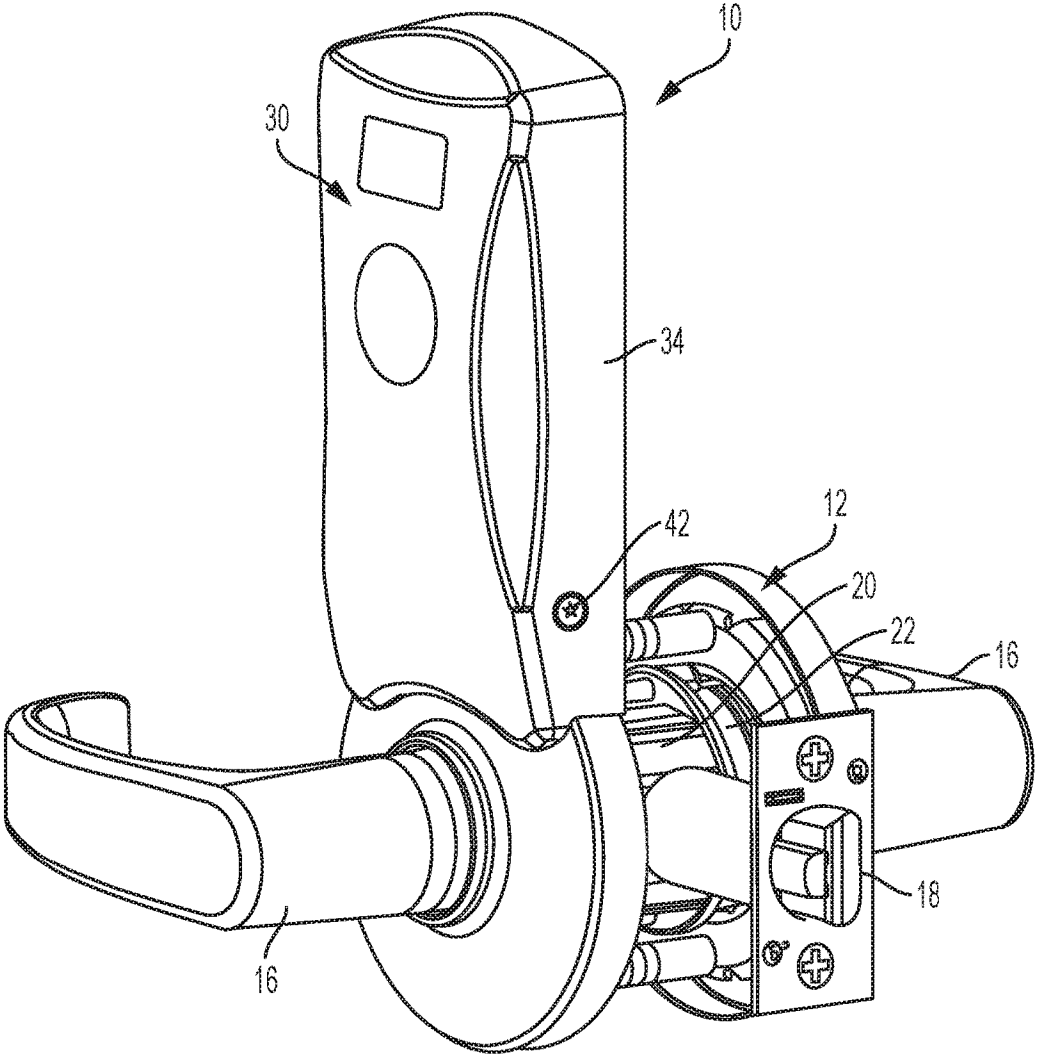
FIG. 3 is an enlarged front perspective detail view of the automatic-connecting system of FIG. 1, with the door omitted for clarity.
Figure 5:
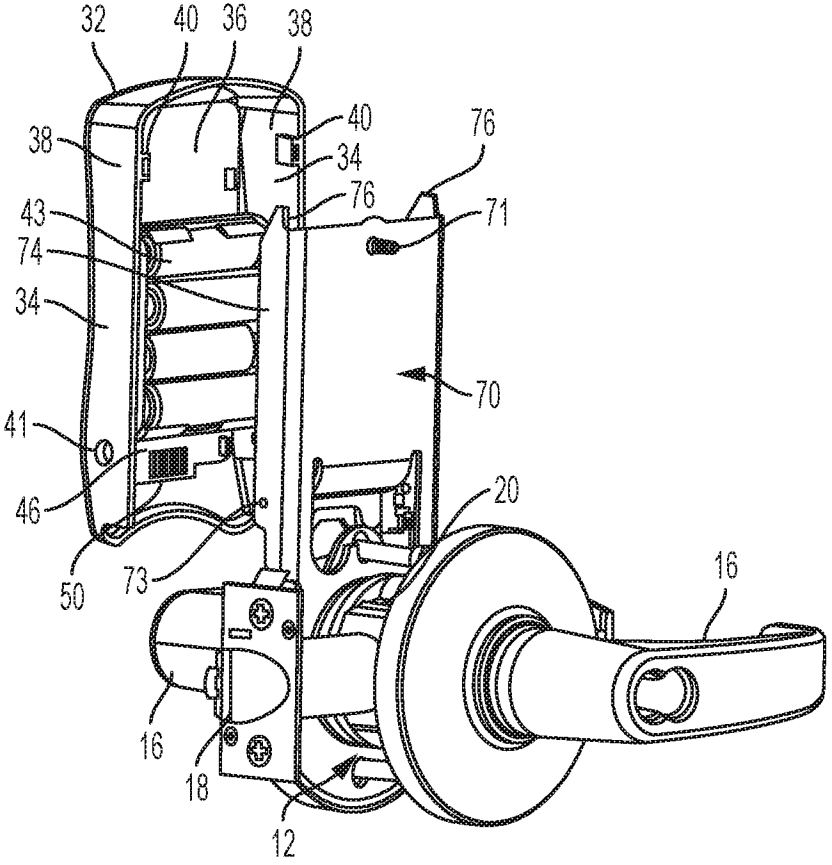
FIG. 5 is an exploded perspective detail view of the automatic-connecting system of FIG. 1, taken from the rear.
Figure 4:
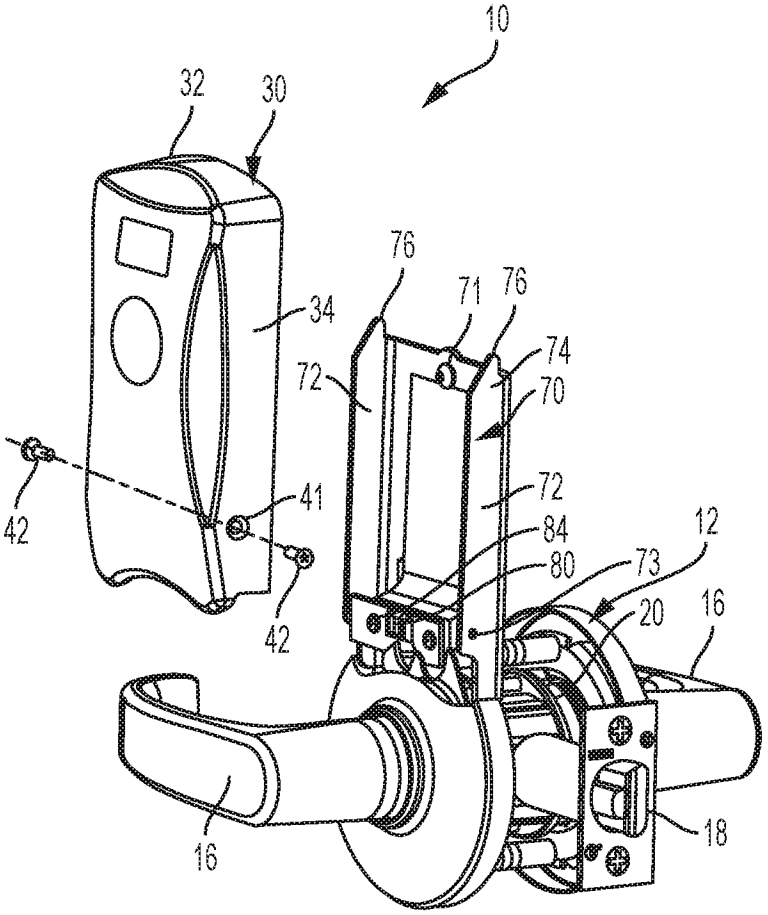
FIG. 4 is an exploded perspective detail view of the automatic-connecting system of FIG. 1, taken from the front.
Figure 6:
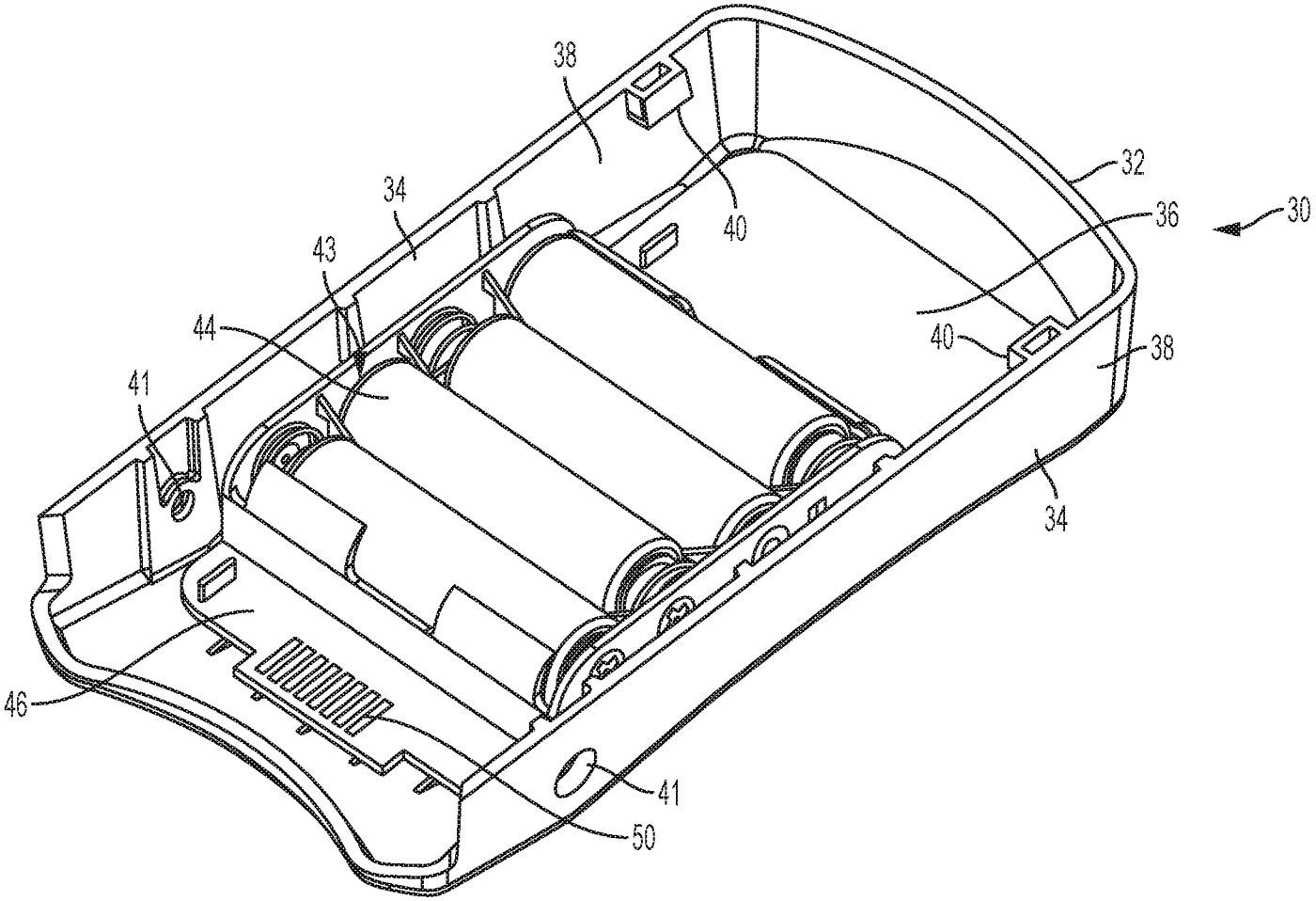
FIG. 6 is an enlarged perspective detail view of the housing subassembly of FIG. 5.

With reference now to the drawings, in particular to FIGS. 1-22, thereof, apparatuses, systems, and methods embodying features, principles, and concepts of various exemplary embodiments of an automatic-connecting system for a door lock assembly will be described. Referring now to FIGS. 1-3, a control module 10 embodying an automatic-connecting system for a door lock assembly, in accordance with one embodiment of the present invention, includes a housing subassembly 30 connected to a mounting bracket 70, as will be discussed shortly.

Still referring to FIGS. 1-3, a door lock assembly 12 is mounted on a door 14 and includes handles 16 operatively associated with a latch subassembly 18. Rotating one of the handles 16 actuates a cylinder lock chassis subassembly 20, which is aligned along a spindle axis 21 with an electric motor 22. Rotating a handle 16 therefore actuates the latch subassembly 18. An example of such a motorized cylindrical lock assembly 12 is the BEST® 9KX. Referring for the moment to FIGS. 10A-11B, motor wires 24 terminating in a motor connector 26 electrically connect the motor 22 to the control module 10, so that the door lock assembly 12 can also be remotely actuated. In one embodiment, the door lock assembly 12 may be remotely actuated by a gateway or other central control system for the school lockdown system. For example, a member of the school staff may initiate a lockdown by actuating a key fob. The key fob can then transmit a radio signal to the gateway instructing the gateway to initiate a lockdown for the school. Upon receipt of the lockdown signal from the key fob, the gateway can then transmit a lockdown instruction to the radio receiver or transceiver disposed in control modules associated with respective door lock assemblies distributed throughout the school. Circuitry in the control modules may, for example, then cause their respective powered door lock assemblies to lock the doors. When the event that precipitated the lockdown has been resolved, a school staff member can instruct the gateway to cancel the lockdown. The gateway will then send the appropriate signal to the various control modules, which may, for example, cause their respective door lock assemblies to revert to their previous states.

Referring now to FIGS. 4-6 and 7A-7C, the housing subassembly 30 includes a housing 32, which may be formed of a plastic, such as MAKROLON® 6485 polycarbonate, having a U.L. 94V-O flame rating. The housing 32 defines two opposing parallel side portions 34 disposed perpendicularly to a base portion 36. Respective upper portions 38 of the side portions 34 define detents 40. The side portions 34 also define fastener orifices 41, into which housing fasteners 42 are inserted to connect the housing subassembly 30 to the mounting bracket 70. As shown particularly in FIG. 6 and in FIGS. 7A-7C, mounted in the housing 32 is a battery subassembly 43 which, in the present embodiment, includes four AA batteries 44. It will be understood that the numbers and types of batteries 44 may be selected to match the specific application of the present invention, and is not limited in this regard.

Figure 7B:
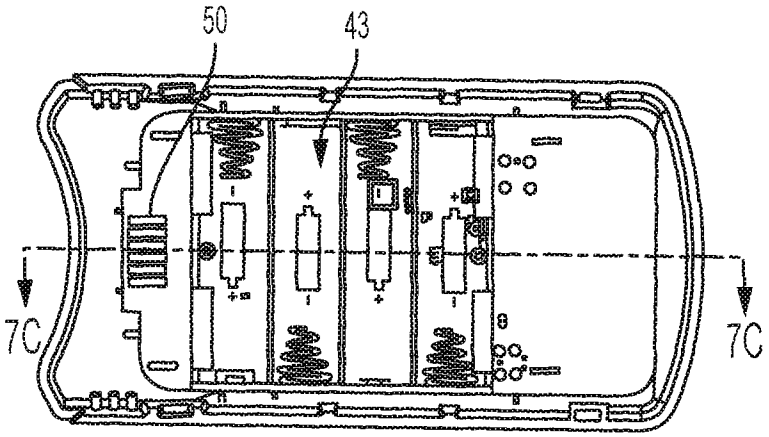
FIG. 7B is a top plan view of the housing subassembly of FIG. 6.
Figure 7C:
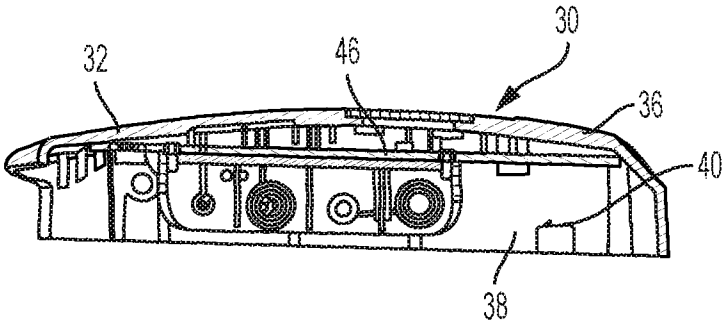
FIG. 7C is an elevational sectional detail view, taken along lines 7C-7C, of FIG. 7B.
Figure 7A:
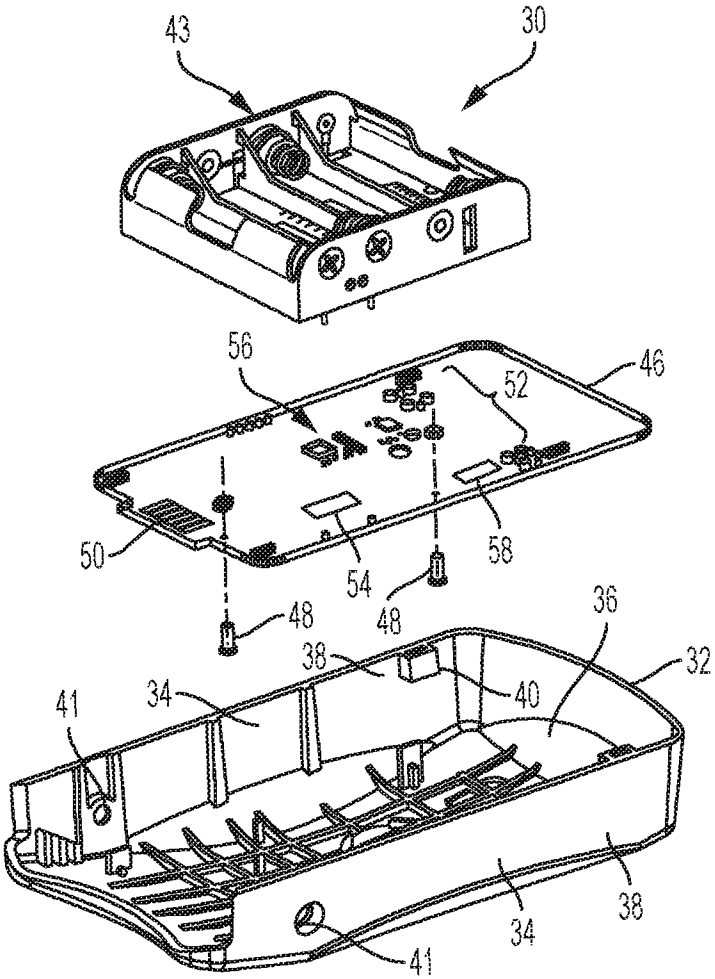
FIG. 7A is an exploded perspective detail view of the housing subassembly shown in FIG. 6.
Figure 8:
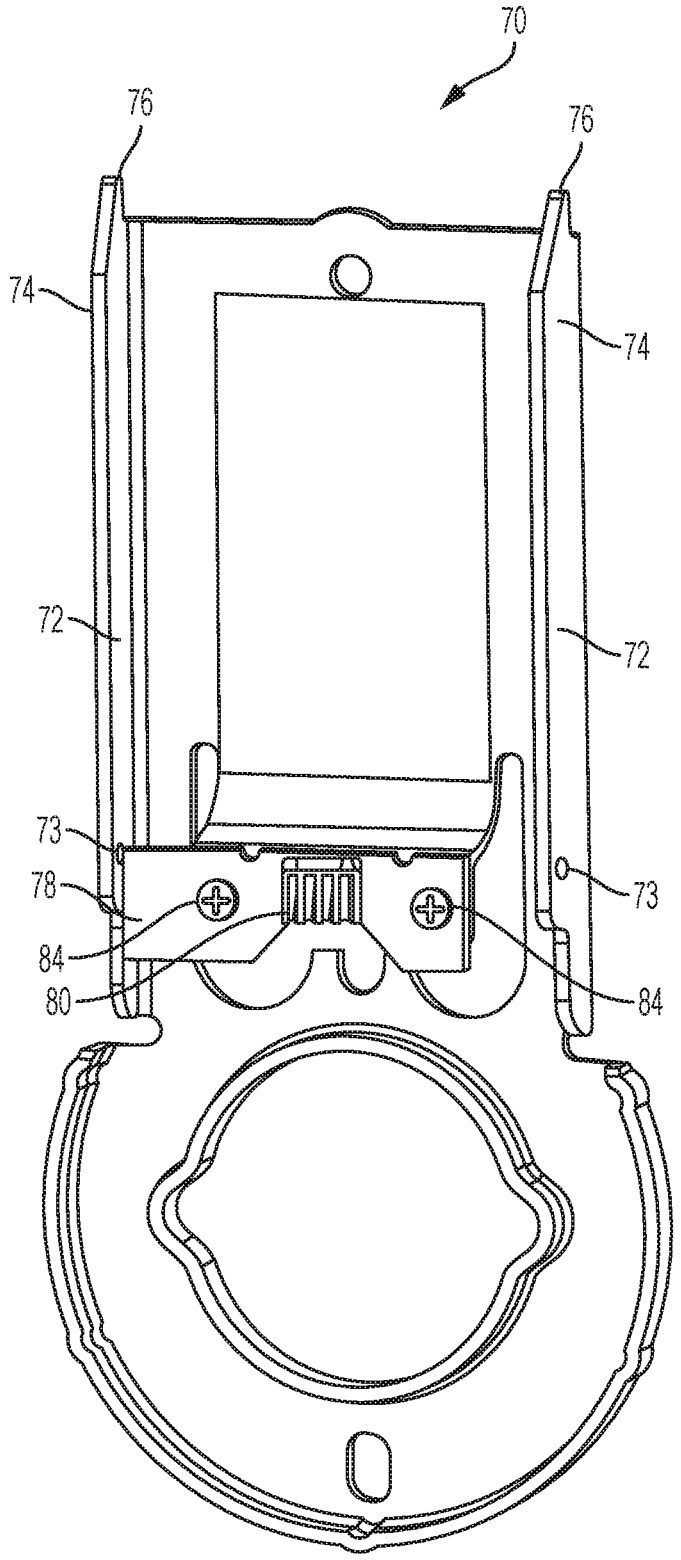
FIG. 8 is a front perspective detail view of the mounting bracket of FIG. 4.

As is also shown in FIGS. 6 and 7A-7C, a circuit board 46 is connected to the battery subassembly 43 with circuit board fasteners 48. A plurality of flat wiping electrical terminals 50, such as flat rectangular contacts, are disposed in a planar array on the circuit board 46, so that at least portions of respective contacts lie substantially in the same plane. There are illustrated eight such terminals 50 in the present embodiment, but it will be understood that the numbers and configurations of such terminals may be adapted to fit the particular application. As shown in FIG. 7A, the flat wiping electrical terminals 50 are operatively associated with the battery subassembly 43, and with an electrical circuit 52 disposed on the circuit board 46. The electrical circuit 52 may include, for example, an anti-tamper circuit 54, a microprocessor 56 and a transceiver 58.

Referring again to FIGS. 2, 4 and 5, the mounting bracket 70 is connected to the door 14 with a mounting bracket fastener 71, and is also trapped between elements of the lock assembly 12 and the door. As shown in FIGS. 8 and 9A-9D, the mounting bracket 70 defines parallel side portions 72, which in turn define respective housing fastener apertures 73, which are configured to be aligned with corresponding fastener orifices 41 of the housing 32 when the housing subassembly 30 is connected to the mounting bracket 70.

Still referring to FIGS. 8 and 9A-9D, the side portions 72 also include respective upper portions 74, which define respective detent-engaging portions 76. As will be discussed later in respect of the heat-activated release system of the present invention, at least the detent-engaging portions 76 should be formed of a heat-conducting material, such as metal. In alternate embodiments, the entire mounting bracket 70 may be formed of metal. A MYLAR® film 79 is positioned on the mounting bracket 70 to electrically insulate the mounting bracket from portions of the housing subassembly 30.

As shown in FIGS. 9A-9D, a transfer board 78 is connected to the mounting bracket 70. A plurality of wiping terminal fingers 80 are disposed on the transfer board 78. The wiping terminals 80 may be of the spring-type, or may be otherwise biased in a direction towards wiping contact with respective wiping electrical terminals 50 of the housing subassembly 30. As shown particularly in FIG. 9B by the dotted lines, electrically-conductive traces 81 on the other side of the transfer board 78 connect terminal nos. 1 and 4 of the wiping electrical terminals 80 (see FIG. 9D) with metal transfer board fasteners 84. Metal transfer board fasteners 84 in turn connect the transfer board 78 (and therefore the electrically-conductive traces 81, and terminal nos. 1 and 4) with the mounting bracket 70. Inasmuch as the mounting bracket 70 is connected to grounded portions of the lock assembly 12, in the embodiment when the mounting bracket is made of metal, this connection results in a chassis ground for terminal nos. 1 and 4 of the plurality of wiping terminals 80. It will be recognized that, in other embodiments, the transfer board fasteners 84 may be formed of materials other than metal. However, in such other embodiments, there will need to be provided an electrical connection between the electrically-conductive traces 81 and the mounting bracket 70.

Figure 10A:
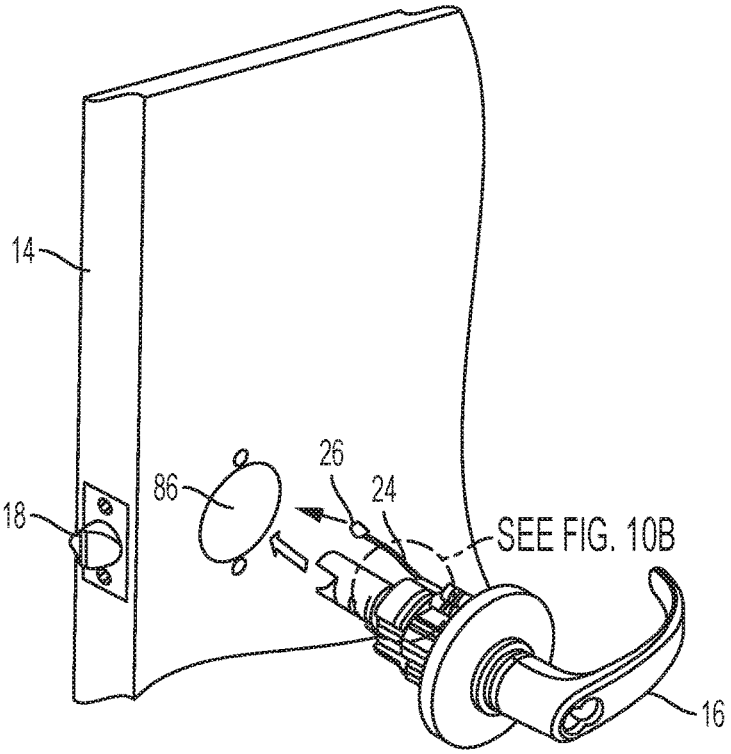
FIG. 10A is a schematic perspective detail view of a portion of the lock assembly of FIG. 2, taken from the other side of the door.
Figure 10B:
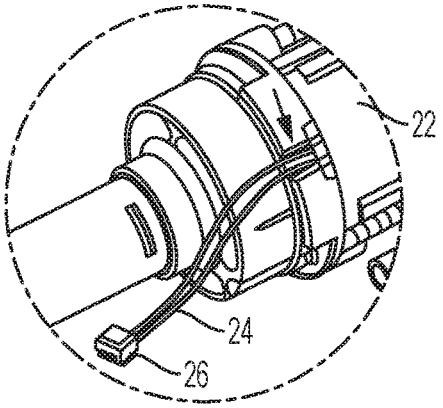
FIG. 10B is an enlarged schematic perspective detail view of the lock assembly of FIG. 10A, illustrating a motor connector.
Figure 11A:
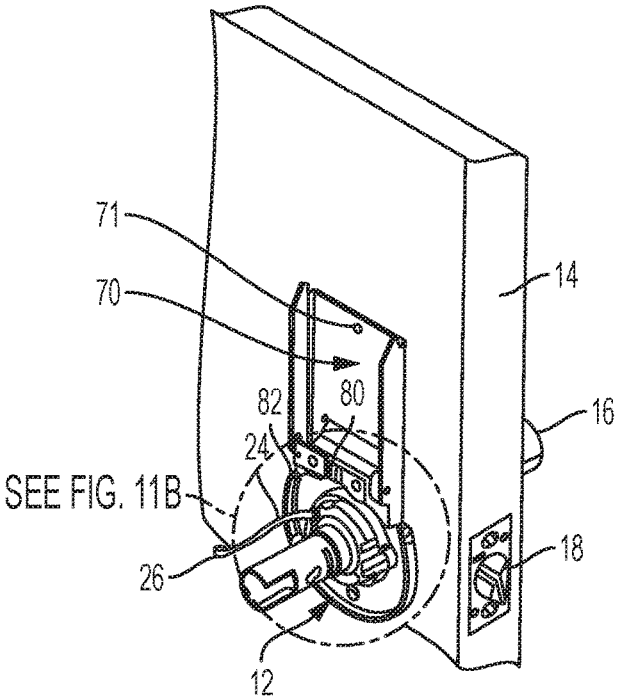
FIG. 11A is a schematic perspective view of a subassembly of the lock of FIG. 10A connected to the mounting bracket of FIG. 8, taken from the front of the door, and illustrating the position of the motor connector of FIG. 10B.
Figure 11B:
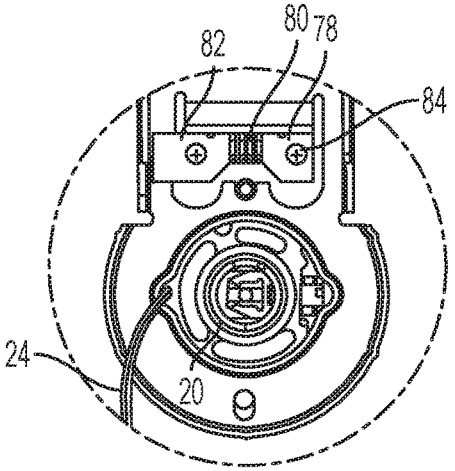
FIG. 11B is an enlarged schematic elevational detail view of the subassembly of FIG. 11A.

Referring to FIG. 2, and to FIGS. 10A-11B, which illustrate partial views of the door 14, the door defines a door aperture 86, through which portions of the lock assembly 12 are inserted from the back. As shown in FIG. 2, a thin-door spacer 88 may be disposed between the door 14 and the mounting bracket 70. When the lock assembly 12 is assembled to the door 14 via the door aperture 86, the motor wires 24 and motor connector 26 are also inserted through the door aperture, as shown in FIG. 10A. With the mounting bracket 70 attached to the door 14 using fastener 71, the lock assembly 12 can be inserted through the door aperture 86 and the mounting bracket 70. Then the rest of the components of the lock assembly 12 may be assembled on the near side of the door 14. Note that the motor wires 24 and motor connector 26 protrude through the door aperture 86. As shown in FIG. 9D, the motor connector 26, or first electrical connector, can then be inserted into the motor connector receptacle 82, or second electrical connector, disposed on the transfer board 78. Still referring to FIG. 9D, and for the moment also to FIG. 16, the motor connector receptacle 82 is electrically connected to terminal nos. 2 and 3 of the plurality of wiping electrical terminal terminals 80. Therefore, when the housing subassembly 30 is assembled on the mounting bracket 70, terminal nos. 3 and 2 of wiping electrical terminals 80 (a first plurality of wiping electrical terminals) disposed on the transfer board 78, mechanically and electrically engage contact nos. 4 and 5, respectively, of wiping electrical terminals 50 (a second plurality of wiping electrical terminals), disposed on the circuit board 46. The control module 10 of the present invention is thus electrically connected to the motor 22 of the door lock assembly 12, without having to use any special wiring harnesses or plug-and-socket connectors to link the control module with the lock motor.

Figure 12:
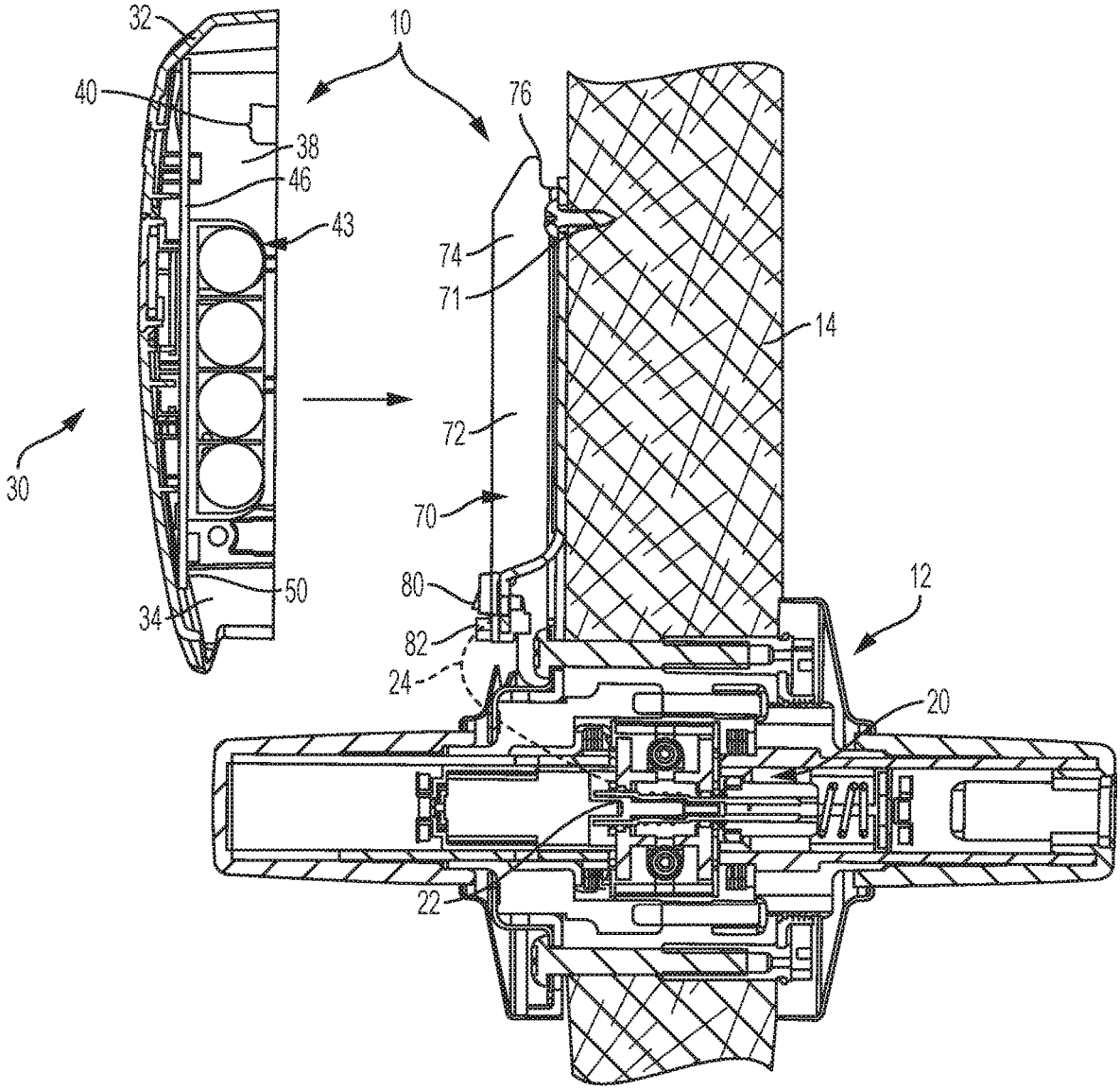
FIGS. 12-14 are progressive schematic elevational sectional views of the housing being attached to the mounting bracket and lock assembly of FIG. 4.
Figure 13:
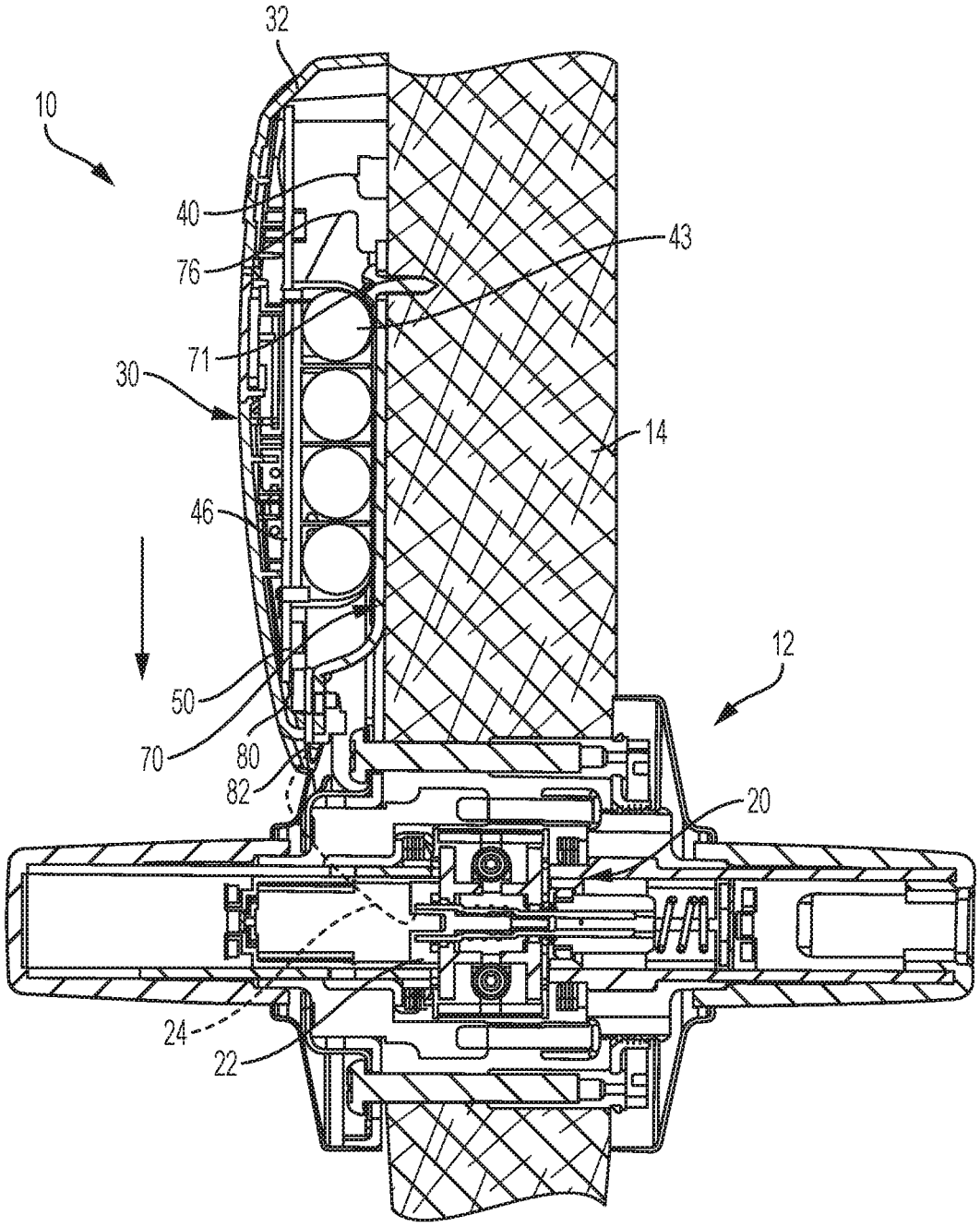
Figure 14:
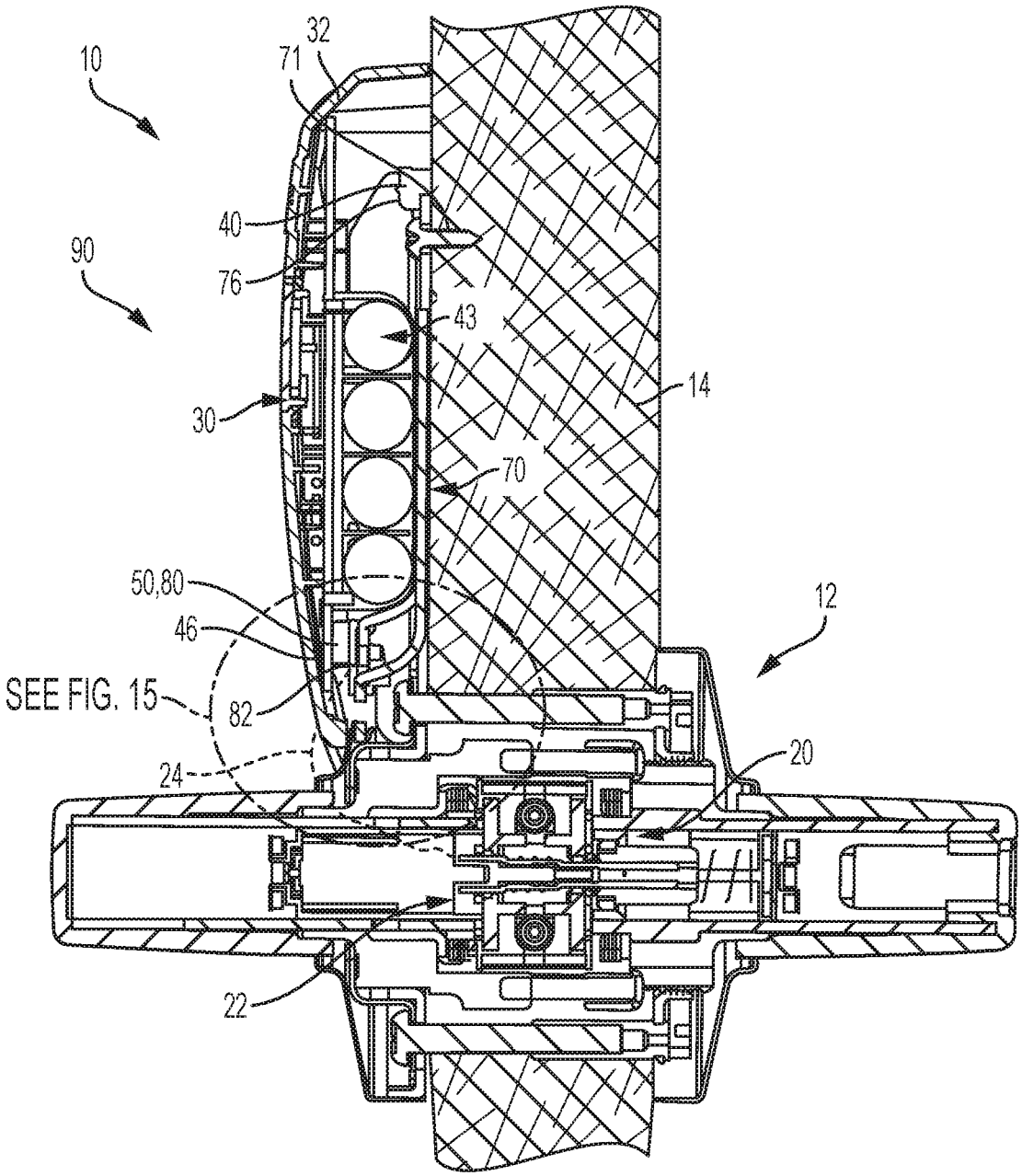

A method of connecting the housing subassembly 30 to the mounting bracket 70 is illustrated progressively in FIGS. 12-14. As shown by the arrow in FIG. 12, the housing subassembly 30 is first moved so that it is adjacent and parallel to the mounting bracket 70. Then, as shown by the downward arrow in FIG. 13, the housing subassembly 30 is slidably moved downwardly along, and parallel to, the mounting bracket 70, so that respective wiping electrical terminals 50 in the housing subassembly begin to slidably engage respective wiping electrical terminals 80 disposed on the transfer board 78 of the mounting bracket 70. (Note the positions of the motor wires 24, shown in phantom.) Finally, as illustrated in FIG. 14, the housing subassembly 30 is moved downwardly along the mounting bracket 70 until respective detents 40 on the housing subassembly engage corresponding detent-engaging portions 76 of the mounting bracket with a slight interference fit. The housing subassembly 30 has now been releasably connected to the mounting bracket 70 to form a housing and mounting bracket assembly 90. As shown in FIGS. 1-5, fasteners 42 may also be used to connect respective side portions 34, 72 of the housing subassembly 30 and the mounting bracket 70.

Figure 15:
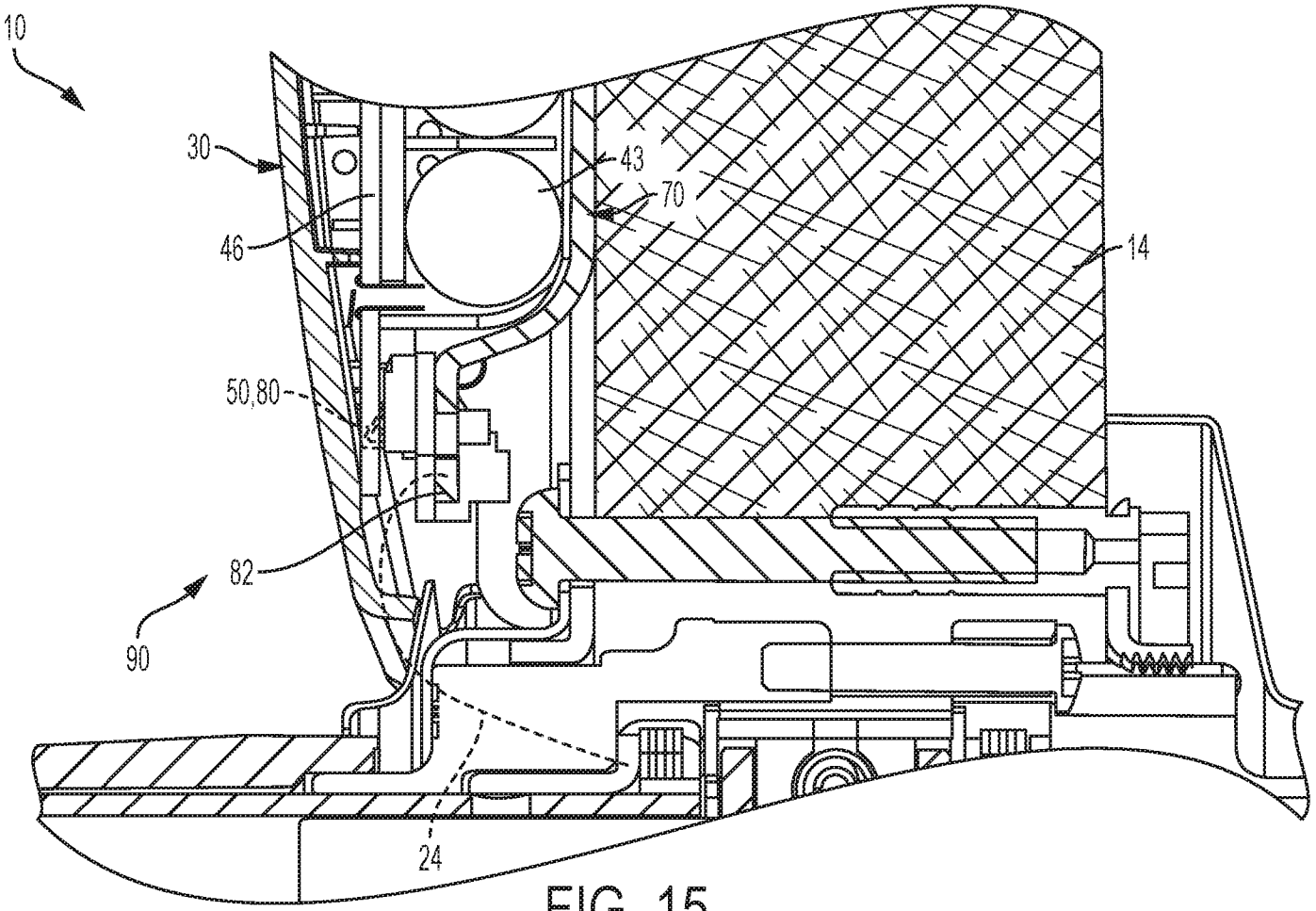
FIG. 15 is an enlarged schematic elevational sectional detail view of the circled portion of FIG. 14.
Figure 16:
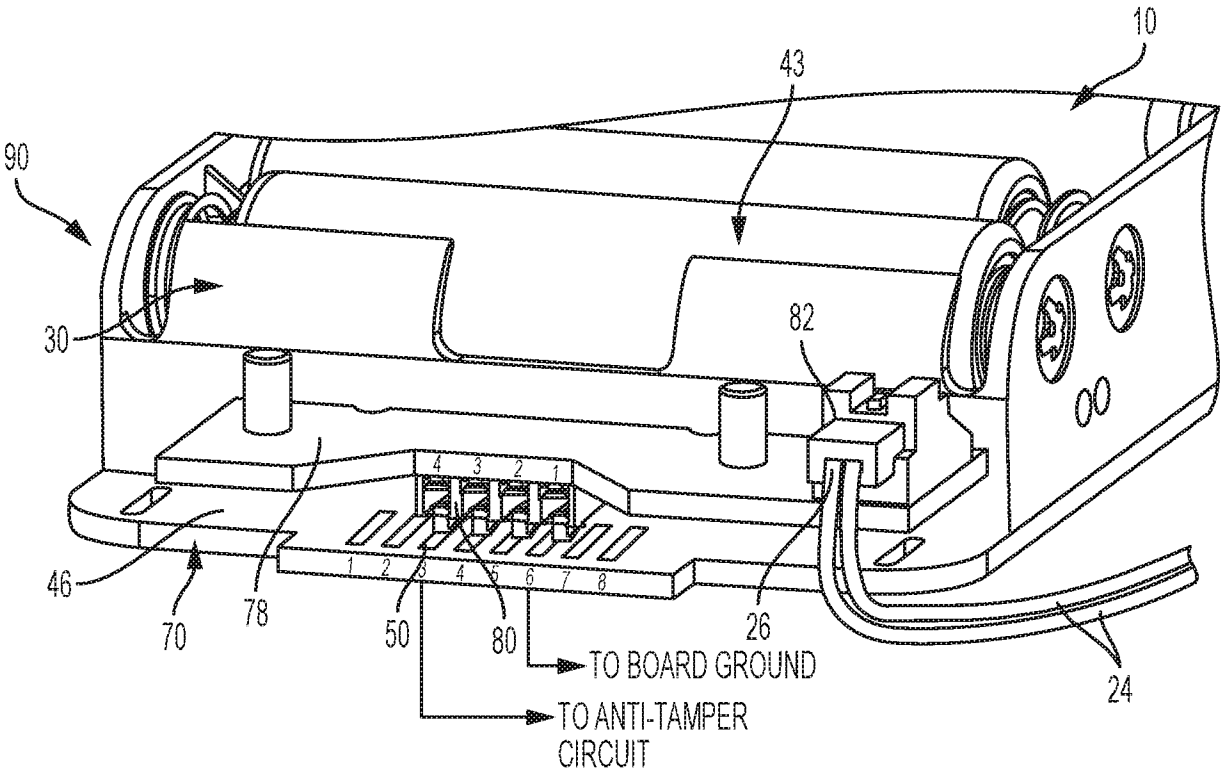
FIG. 16 is a partial schematic perspective detail view of a subassembly of the housing and mounting bracket of FIG. 15, illustrating the electrical connection of the transfer board with the motor of the lock assembly, and the mutual wiping connection of terminals on the transfer board with counterpart terminals on the circuit board mounted on the housing.

Enlarged detail views of the respective terminal connection areas of the housing and mounting bracket assembly 90 are shown in FIGS. 15 and 16. They illustrate that terminal nos. 4-1 of wiping electrical terminals 80 are slidably connected, respectively, to terminal nos. 3-6 of wiping electrical terminals or contacts 50. In the present embodiment, terminal nos. 1, 2, 7 and 8 of the plurality of wiping electrical terminals 50 are not used, but it will be appreciated that such unused terminals could be used in other applications of the present invention.

To summarize, and referring to FIGS. 12-16, when the housing subassembly 30 is moved downwardly along the mounting bracket 70, respective wiping electrical terminals 50 in the housing subassembly 30 slidably engage respective wiping electrical terminals 80 disposed on the transfer board 78 of the mounting bracket 70. When the housing subassembly 30 is thus connected to the mounting bracket 70, the motor 22 is now electrically connected to terminals or contacts nos. 4 and 5, respectively, of wiping electrical terminals 50 disposed on the circuit board 46 of the housing subassembly 30. That means that the motor 22 may now be controlled by elements of the electrical circuit 52 disposed on the circuit board 46 (see FIG. 7A). Furthermore, terminals or contacts nos. 3 and 6, respectively, of wiping electrical terminals 80 disposed on the circuit board 46 are now electrically connected to chassis ground. This latter arrangement may be used as a foundation for an anti-tamper system 51.

Figure 17:
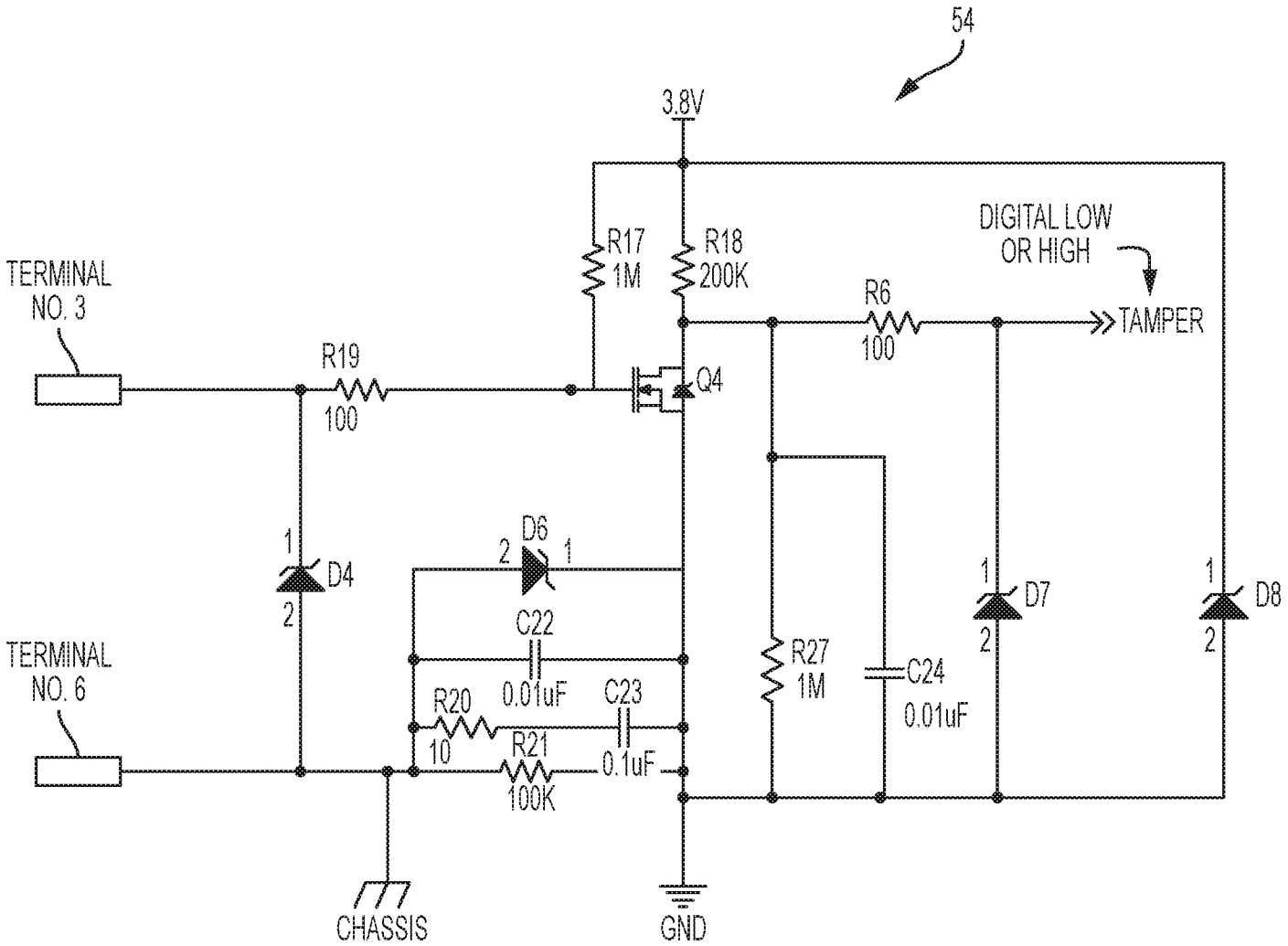
FIG. 17 is an electrical schematic of the anti-tamper circuit disposed on the circuit board shown in FIG. 7A.
Figure 18:
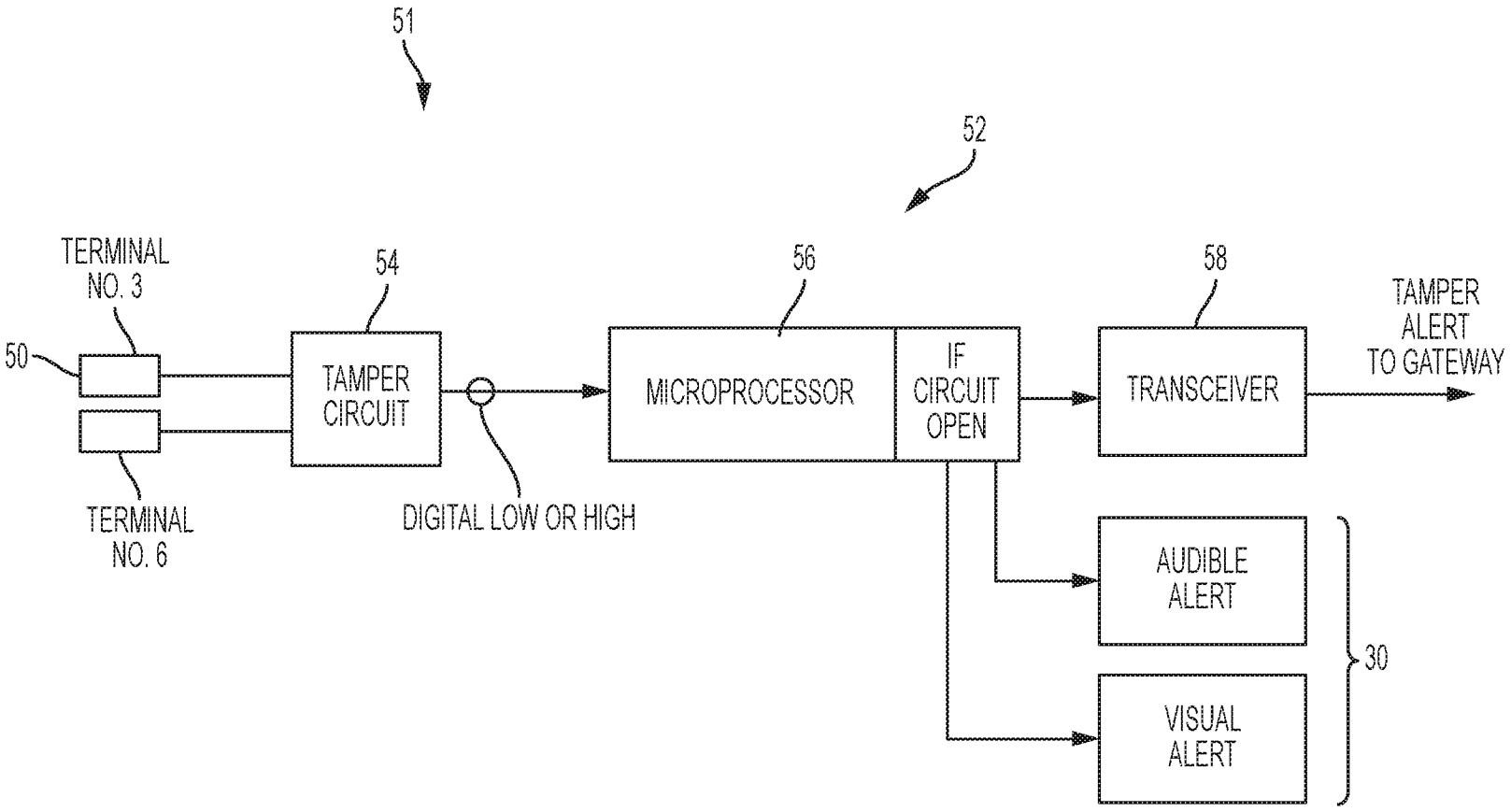
FIG. 18 is a block diagram of an anti-tamper system incorporating the circuit shown in FIG. 17.

Referring to FIGS. 7A, 17 and 18, an anti-tamper system 51 of the present invention may include an anti-tamper circuit 54 connected between terminal no. 3 of wiping electrical terminals 50, and a microprocessor 56, terminal no. 6 being electrically connected to chassis ground and printed circuit board ground. The anti-tamper circuit 54 detects when terminal no. 3 is electrically disconnected from its counterpart terminal no. 4 of the wiping electrical terminals 80 on the transfer board 78, thereby indicating a tamper condition, such as when someone attempts to disable the lockdown system in a particular classroom, or when such an electrical connection between the control module 10 and the lock assembly 12 is otherwise broken. The anti-tamper circuit 54 can detect when either of the terminal nos. 1 or 4 on the transfer board 78 is no longer connected to its respective counterpart terminal no. 6 or 3, of the plurality of wiping electrical terminals or contacts 50, on the circuit board 46.

Basically, the anti-tamper circuit 54 acts as a switch. When terminal no. 3 or 6 on the circuit board 46 is disconnected from its respective counterpart terminal no. 4 or 1 on the transfer board 78, the anti-tamper circuit 54 outputs a digital high, indicating a tamper condition (such as an open circuit to ground in the control module 10). When the connection remains intact, however, the anti-tamper circuit 54 outputs a digital low, indicating that no tamper condition exists. In at least one embodiment, an explanation of how such a circuit works may be found at www.electronics-tutorials.ws/transistor/tran_7.html.

Referring again to FIG. 18, the digital low or digital high output is provided to the microprocessor 56, which may be, for example, a Silicon Labs EFM32G222F64-QFP48. When the microprocessor 56 detects a tamper condition input, it will generate a tamper alert. The tamper alert may be provided to a transceiver 58 with instructions to transmit the alert to a gateway, which can control the entire lockdown system. The transceiver 58 may be provided with its own microprocessor. The microprocessor 56 may also cause an audible alert and/or a visual alert to be produced right at the housing assembly 30 of the control module 10.

The automatic-connecting system for a door lock assembly embodied in the control module 10 of the present invention also lends itself well to an elegant solution of the problem of how to jettison an electronics package and batteries from the door lock assembly in the event of a fire.

Figure 20:
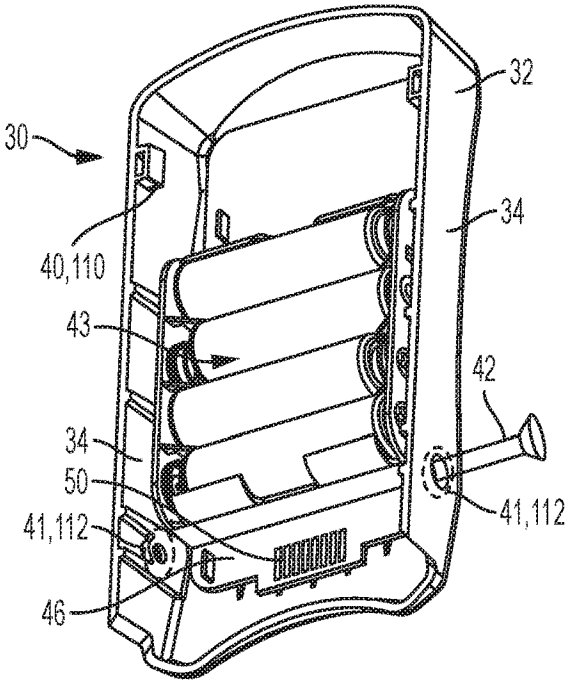
FIG. 20 is a view similar to that of FIG. 6, illustrating the melting of portions of the side portions of the plastic housing by fasteners connecting the housing to the mounting bracket.
Figure 19B:
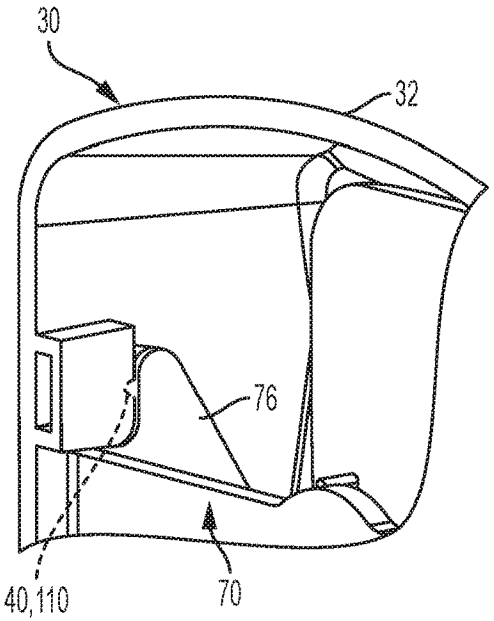
FIG. 19B is an enlarged schematic perspective detail view of the circled portion of FIG. 19A, illustrating the melting of the detent formed on the plastic housing by the metal detent-engaging portion of the mounting bracket.
Figure 19A:
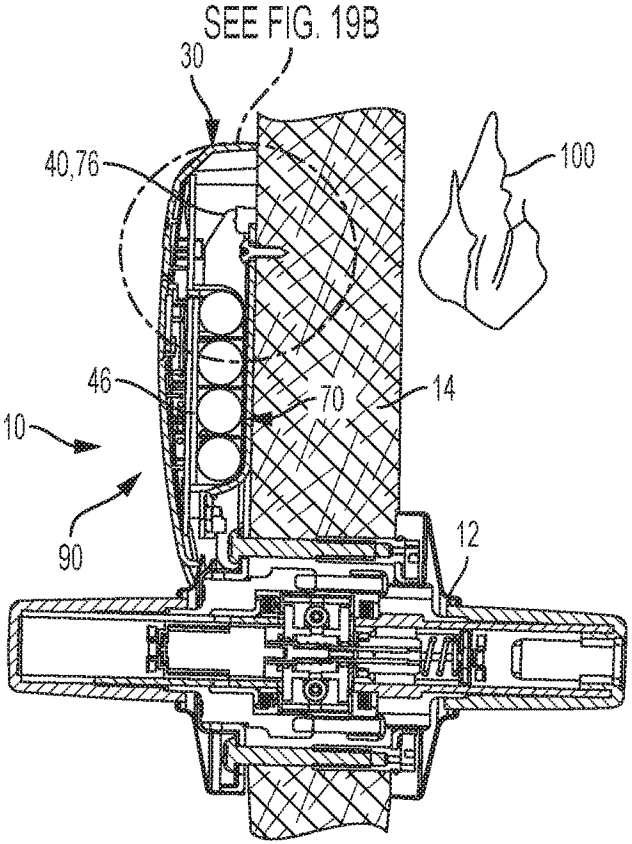
FIG. 19A is an elevational schematic sectional view of the assembly of housing, mounting bracket and lock shown in FIG. 14, being exposed to a fire.

FIGS. 19A, 19B and 20 schematically illustrate how a fire 100 can cause the mechanical connections between housing subassembly 30 and mounting bracket 70 to be released. When the ambient temperature rises sufficiently to cause the detent-engaging portions 76 of the mounting bracket 70 to melt the plastic detents 40, as shown in FIG. 19B, there remains no material on the housing subassembly 30 which can hold the detent-engaging portions. Thus there no longer remains the slight interference fit between the detents 40 and respective detent-engaging portions 76. Therefore, in the embodiment in which fasteners 42 are not also used to connect the housing subassembly 30 to the mounting bracket 70, there remains literally nothing holding the housing subassembly 30 on the mounting bracket 70. Here is where the design of the mutual sliding engagement of the respective wiping electrical terminals 50, 80 once again becomes important. The wiping electrical terminals 50, 80 are parallel to one another, and are all disposed vertically in the control module 10. That means that the wiping electrical terminals 50, 80 themselves can offer no mechanical resistance to a downward force directed upon the housing subassembly 30 tending to separate the terminals.

As was noted above, housing subassembly 30 includes, among other elements, a housing 32, a battery subassembly 44 and a printed circuit board 46. In many embodiments, housing 32, battery subassembly 44 and printed circuit board 46 have non-negligible weight. In fact, the weight of the housing subassembly 30 can be perceived just by holding it in one's hand. Accordingly, the force of gravity, which is always acting upon the housing subassembly 30, tends to pull the housing subassembly 30 downward and away from the mounting bracket 70. Inasmuch as the wiping electrical terminals 50, 80 themselves offer no resistance to the downwardly-directed pull of gravity, and inasmuch as the sole mechanical connections between the housing subassembly 30 and the mounting bracket 70 have been melted away, the force of gravity now succeeds in pulling the housing subassembly downward and away from the mounting bracket. Consequently, the mounting subassembly 30, together with its contents, have been successfully jettisoned from the door lock assembly 12 solely by the interaction of the force of gravity with the melting of certain portions of the housing 32.

Furthermore, in those embodiments in which fasteners 42 are also used to connect the housing subassembly 30 to the mounting bracket 70, the same rise in ambient temperature that melted the detents 40 will cause the fastener orifices 41 to melt and to enlarge significantly around the fasteners 42 to then reach a new configuration 112, where the fasteners 42 no longer maintain a mechanical connection between the housing subassembly 30 and the mounting bracket 70. The result is the same as just noted above. Now nothing prevents the force of gravity from pulling the housing subassembly 30 downward and away from the mounting bracket 70.

Figure 22:
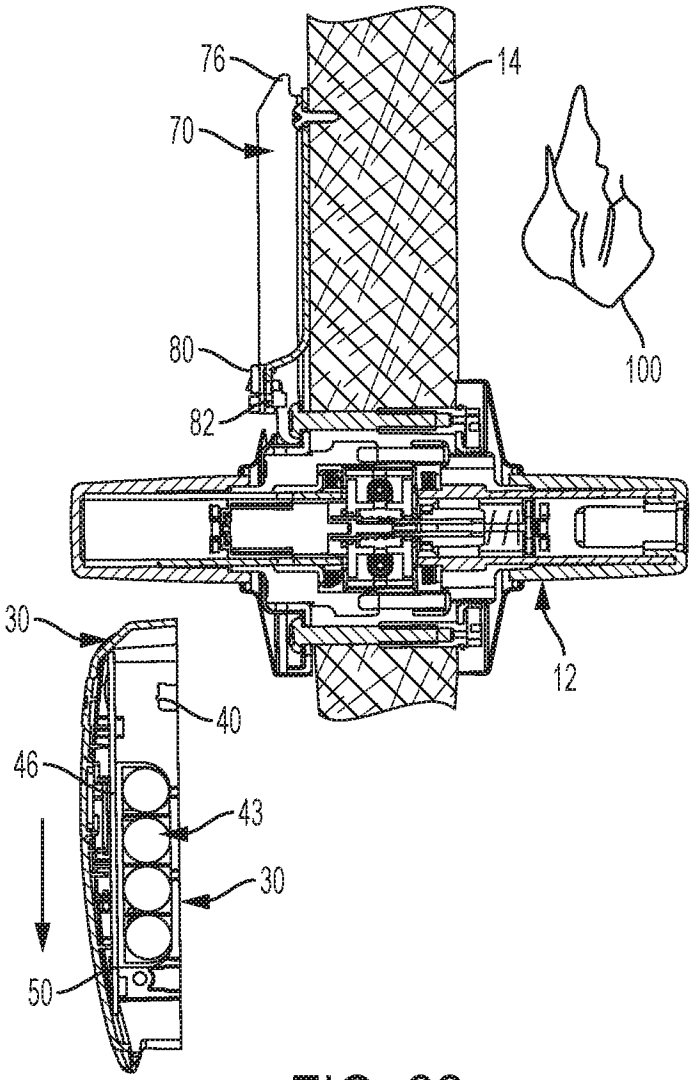
FIG. 22 is a view similar to that of FIG. 21, illustrating the complete jettisoning of the housing subassembly, along with its batteries and electric circuit, from the lock assembly, due solely to the effects of the force of gravity interacting with melting of portions of the plastic housing.
Figure 21:
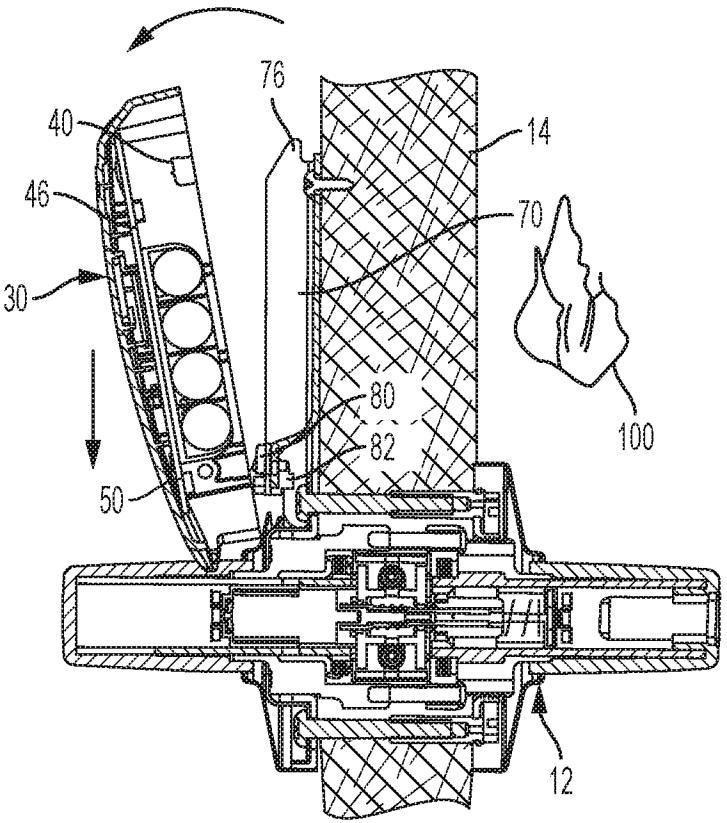
FIG. 21 is a view similar to FIG. 19A, illustrating the initial effects of the force of gravity interacting with the melting of portions of the plastic housing.

FIGS. 21 and 22 schematically illustrate many embodiments of the interaction of the force of gravity with the melting described above with respect to FIGS. 19A, 19B and 20. In some embodiments, as shown in FIG. 21, the dispositions of the various centers of gravity of the components of the housing subassembly 30, and their respective weights, coact to pivot the housing subassembly 30 away from the mounting bracket 70. As the housing subassembly 30 separates from the mounting bracket 70, the wiping electrical terminals 50, 80 necessarily become disconnected, inasmuch as the two sets of wiping electrical terminals are not mechanically held together, as they are in many conventional connection systems. In other embodiments, the effects of the force of gravity upon various arrangements of the parts of the housing subassembly 30 may cause the housing subassembly simply to drop straight down, as shown in FIG. 22, or to fall away from the mounting bracket in other, generally downward, directions. The result in any case is the same: once the force of gravity separates the housing subassembly 30 from the mounting bracket 70, there remain no mechanical or electrical connections of any type whatsoever between the housing subassembly and the door lock subassembly 12.

It can be seen that the automatic-connecting system for a door lock assembly of the present invention not only yields a control module having a mounting subassembly which can be quickly and releasably connected to a door lock assembly, but also provides an uncomplicated solution to the problem of jettisoning the batteries and electronics package of a control system from a motorized door lock assembly during a fire.

While the present invention has been described with respect to various embodiments of a control module for a door lock assembly, the present invention may be further modified within the spirit and scope of this disclosure to apply to other products as well. This application is therefore intended to cover any variations, uses, or adaptations of the present invention using its general principles. The accompanying drawings illustrate exemplary embodiments of the invention. Alternative embodiments, examples, and modifications which would still be encompassed by the invention may be made by those skilled in the art, particularly in light of the foregoing teachings. The example and alternative embodiments described above may be combined in a variety of ways with each other. Further, the steps and number of the various steps illustrated in the figures may be adjusted from that shown. Furthermore, this application is intended to cover such departures from the present disclosure as come within known or customary practice in the art to which this invention pertains and which fall within the limitations of the appended claims. Those skilled in the art should now appreciate that various adaptations and modifications of the example and alternative embodiments described above can be configured without departing from the scope and spirit of the invention. Therefore, it is to be understood that, within the scope of the appended claims, the invention may be practiced other than as specifically described herein.

What is claimed is:

1. An automatic-connecting system for a door lock assembly, comprising:

a mounting bracket connected to the door lock assembly;

wherein the mounting bracket includes a first plurality of wiping electrical terminals, at least one terminal of which is electrically connected to the door lock assembly; and further comprising:

a housing connected to the mounting bracket;

wherein the housing includes both a battery subassembly and an electrical circuit;

the housing further includes a second plurality of wiping electrical terminals disposed in a planar array and operatively associated with the at least one of the battery subassembly and the electrical circuit;

the first and second pluralities of wiping electrical terminals are configured for wiping contact when the housing is moved parallel to the mounting bracket, to electrically connect the at least one of the battery subassembly and the electric circuit with the door lock assembly; and wherein no other electrical connections are required between the housing and the mounting bracket to electrically connect the at least one of the battery subassembly and the electrical circuit with the door lock assembly.

2. The automatic-connecting system claimed in claim 1, wherein no tools are required to electrically connect the at least one of the battery subassembly and the electric circuit with the lock subassembly.

3. The automatic-connecting system claimed in claim 1, wherein the lock assembly includes a motor;

the electric circuit and the planar array of the second plurality of wiping electrical terminals are disposed on a circuit board;

the motor is operatively connected to a first electrical connector;

the first electrical connector is electrically connected to a second electric connector disposed on the mounting bracket;

the second electrical connector is electrically connected to at least one of the terminals of the first plurality of wiping terminals; and wherein, when the housing is connected to the mounting bracket, the motor is operatively connected to the electric circuit.

4. The automatic-connecting system claimed in claim 3, further comprising:

an anti-tamper system that generates an alert if one of the first plurality of wiping terminals is electrically disconnected from its electrical counterpart in the second plurality of wiping terminals.

5. The automatic-connecting system claimed in claim 4, wherein the anti-tamper system includes a tamper-detecting circuit electrically connected between said counterpart terminal in the second plurality of wiping electrical terminals, and a microprocessor;

the tamper-detecting circuit detects when said one of the first plurality of wiping terminals is electrically disconnected from its electrical counterpart in the second plurality of wiping terminals, and produces an output reflecting the existence of a tamper condition; and wherein, in response to the output from the tamper-detecting circuit reflecting the existence of the tamper condition, the microprocessor generates an alert.

6. The automatic-connecting system claimed in claim 5, wherein the alert results in one of an instruction to a transceiver to send an alert signal, an initiation of an audible alert, and an initiation of a visual alert.

7. The automatic-connecting system claimed in claim 3, wherein the mounting bracket includes a detent-engaging portion, and the housing includes a detent engaged with the detent-engaging portion to releasably retain the housing on the mounting bracket;

the battery subassembly and the electrical circuit have respective ignition temperatures;

the detent has a melting point temperature lower than the respective ignition temperatures of either the battery subassembly or the electric circuit;

the detent-engaging portion of the mounting bracket is formed of heat-conducting material;

whereby, when the ambient temperatures rises to a point at which the detent-engaging portion of the mounting bracket melts the detent, the housing is released from the mounting bracket.

8. The automatic-connecting system claimed in claim 7, wherein no electrical or mechanical connection remains between the housing and the mounting bracket after the housing falls away from the mounting bracket.

9. The automatic-connecting system claimed in claim 7, wherein the force of gravity in cooperation with the melting of at least a portion of the housing causes the housing to fall away from the mounting bracket.

10. The automatic-connecting system claimed in claim 7, wherein the first and second pluralities of wiping electrical terminals are configured for mutual wiping electrical and mechanical contact when the housing is moved parallel to the mounting bracket to electrically connect the at least one of the battery subassembly and the electric circuit with the door lock assembly.

11. The automatic-connecting system claimed in claim 3, wherein the housing is formed of a plastic material having a melting point temperature lower than the respective ignition temperatures of the battery subassembly and the electrical circuit;

the housing defines two parallel side portions, each side portion including an upper portion defining a detent;

the mounting bracket is formed of metal and has an upper portion defining two detent-engaging portions engaged with respective detents;

whereby, when the ambient temperature rises to a point at which the detent-engaging portions melt the detents, the housing is released from the mounting bracket; and wherein the force of gravity causes the housing to fall away from the mounting bracket.

12. The automatic-connecting system claimed in claim 11, wherein each housing side portion defines a fastener orifice, and further comprising:

a metal fastener connecting each housing side portion with the mounting bracket via the fastener orifice;

whereby, when the ambient temperature rises to a point at which the fasteners melt the material adjacent respective fastener orifices so that the housing is no longer retained on the mounting bracket, the housing can be released from the mounting bracket by the force of gravity.

13. The automatic-connecting system claimed in claim 1, wherein the mounting bracket has a generally U-shaped configuration and defines opposing parallel side portions generally perpendicular to a base portion;

the side portions extend outwardly from the wall and define respective upper portions;

each upper portion includes a detent-engaging portion;

the housing defines parallel housing side portions extending towards respective mounting bracket side portions;

each housing side portion defines a detent; and wherein, when the housing is moved along the mounting bracket, respective detents engage respective detent-engaging portions to releasable retain the housing on the mounting bracket.

14. A method of automatically and releasably connecting an electric circuit disposed in a housing with a motor of a door lock assembly disposed on a door, the door lock assembly including a mounting bracket, comprising:

positioning the housing so that it is adjacent to the mounting bracket;

moving the housing in a direction parallel to the mounting bracket so that respective terminals of a first plurality of wiping terminals disposed on the mounting bracket slide against respective terminals of a second plurality of wiping terminals disposed on the housing;

wherein sliding together the first and second pluralities of wiping terminals activates an anti-tamper system;

wherein at least one of the first plurality of wiping terminals is operatively associated with the motor; and wherein at least one of the second plurality of wiping terminals is operatively associated with the electrical circuit and further comprising:

continuing to move the housing relative to the mounting bracket until a detent on one of the housing and the mounting bracket engages a detent-engaging portion on the other of the housing and the mounting bracket;

wherein the electrical circuit is electrically connected to the motor.

15. The method claimed in claim 14, wherein no other means are required to electrically connect the electric circuit to the motor.

16. The method claimed in claim 14, wherein no plug-and-socket connections are made between the housing and the mounting bracket.

17. A method of jettisoning a housing from a mounting bracket of a lock assembly disposed on a door, the housing attached to the mounting bracket, the housing including flammable items having respective ignition temperatures higher than the melting point of the housing, comprising:

causing an element of the mounting bracket to melt an adjacent portion of the housing when the ambient temperature exceeds the melting point of the housing, so that the force of gravity then jettisons the housing from the mounting bracket.

18. The method claimed in claim 17, wherein the housing includes electric terminals slidably connected to electric terminals disposed on the mounting bracket; and further comprising:

using the force of gravity to disconnect the housing electric terminals from the mounting bracket electric terminals.

19. The method claimed in claim 18, wherein solely the force of gravity completely separates the housing from the mounting bracket.

* * * * *